US006186212B1

(12) United States Patent
Tsuchida

(10) Patent No.: US 6,186,212 B1
(45) Date of Patent: Feb. 13, 2001

(54) SCREEN DEVICE

(75) Inventor: Osamu Tsuchida, Kanagawa (JP)

(73) Assignee: Metaco Inc., Tokyo (JP)

( * ) Notice: Under 35 U.S.C. 154(b), the term of this patent shall be extended for 0 days.

(21) Appl. No.: 09/431,091

(22) Filed: Nov. 1, 1999

(30) Foreign Application Priority Data

Jun. 11, 1998 (JP) ..... 10-316663
Jul. 9, 1999 (JP) ..... 11-253625

(51) Int. Cl.[7] ..... E06B 3/94

(52) U.S. Cl. ..... 160/84.06; 160/194; 160/201; 160/240; 160/271

(58) Field of Search ..... 160/84.06, 31, 160/194, 240, 268.1, 271, 272, 277, 279, 201

(56) References Cited

U.S. PATENT DOCUMENTS 1,425,484 * 8/1922 Jenkins ..... 160/31
1,882,982 * 10/1932 Schiedeskamp ..... 160/31
1,948,262 * 2/1934 Gabriel ..... 160/31
4,557,309 * 12/1985 Judkins ..... 160/84.06
5,873,401 * 2/1999 Tsuchida ..... 160/84.06
5,937,929 * 8/1999 Chen ..... 160/84.06

* cited by examiner

*Primary Examiner*—Blair M. Johnson
(74) *Attorney, Agent, or Firm*—Wenderoth, Lind, & Ponack, L.L.P.

(57) ABSTRACT

A screen is mounted between a pair of screen mounting frames, at least one of which is slidable. One or more sliding guide frames are disposed near an end of the screen which is not mounted to the screen mounting frames. Each sliding guide frame is formed by connecting rigid units, each of which has a pair of sidewalls and a bridging portion, and thereby each sliding guide frame has rigidity and a bending ability. The sliding guide frame also has at least a free end at one end and is capable of being received in and withdrawn from inside one of the screen mounting frames. A stopper mechanism provided for the rigid units preserves straightness of a withdrawn portion of each sliding guide frame.

14 Claims, 13 Drawing Sheets

SCREEN DEVICE

FIELD OF THE INVENTION

The present invention relates to a screen device. More particularly, the present invention relates to a screen device which can be installed under no restrictions when used as light-shielding or light-controlling means such as a curtain or a blind, an insect screen, a fixed partition, a movable partition, or the like and which, in addition, accomplishes excellent operability and shape stability of a screen.

DESCRIPTION OF THE PRIOR ART

Various kinds of screen devices are available as light-shielding means, light-controlling means, insect screens, fixed partitions, add movable partitions However, limitations are imposed on conventional screen devices when installing them because fixed frames located at fringes of a screen are indispensable for the screen devices. These limitations become more conspicuous when screen devices are used as fixed or movable partitions. That is, an esthetical problem occurs Furthermore, it is pointed out that the fixed of frames hinder movement of persons and installation of furniture articles.

On the other hand, fixed frames guide opening and closing movements of a screen so as to smoothen the opening and closing movements thereof. Furthermore, they are effective in stabilizing the shape of the screen. Therefore, it is impossible to remove the fixed frames in an attempt to solve the above-mentioned problems.

SUMMARY OF THE INVENTION

The present invention has an object to provide a screen device which can be installed tinder no restrictions when used as light-shielding means, or light-controlling means such as a curtain or blind, an insect screen, a fixed partition, or a movable partition and which also accomplishes excellent operability and shape stability of the screen.

This and other objects, features and advantages of the present invention will be more apparent upon reading the following detailed specification and drawings, in which:

DETAILED DESCRIPTION OF THE INVENTION

Figure 1:
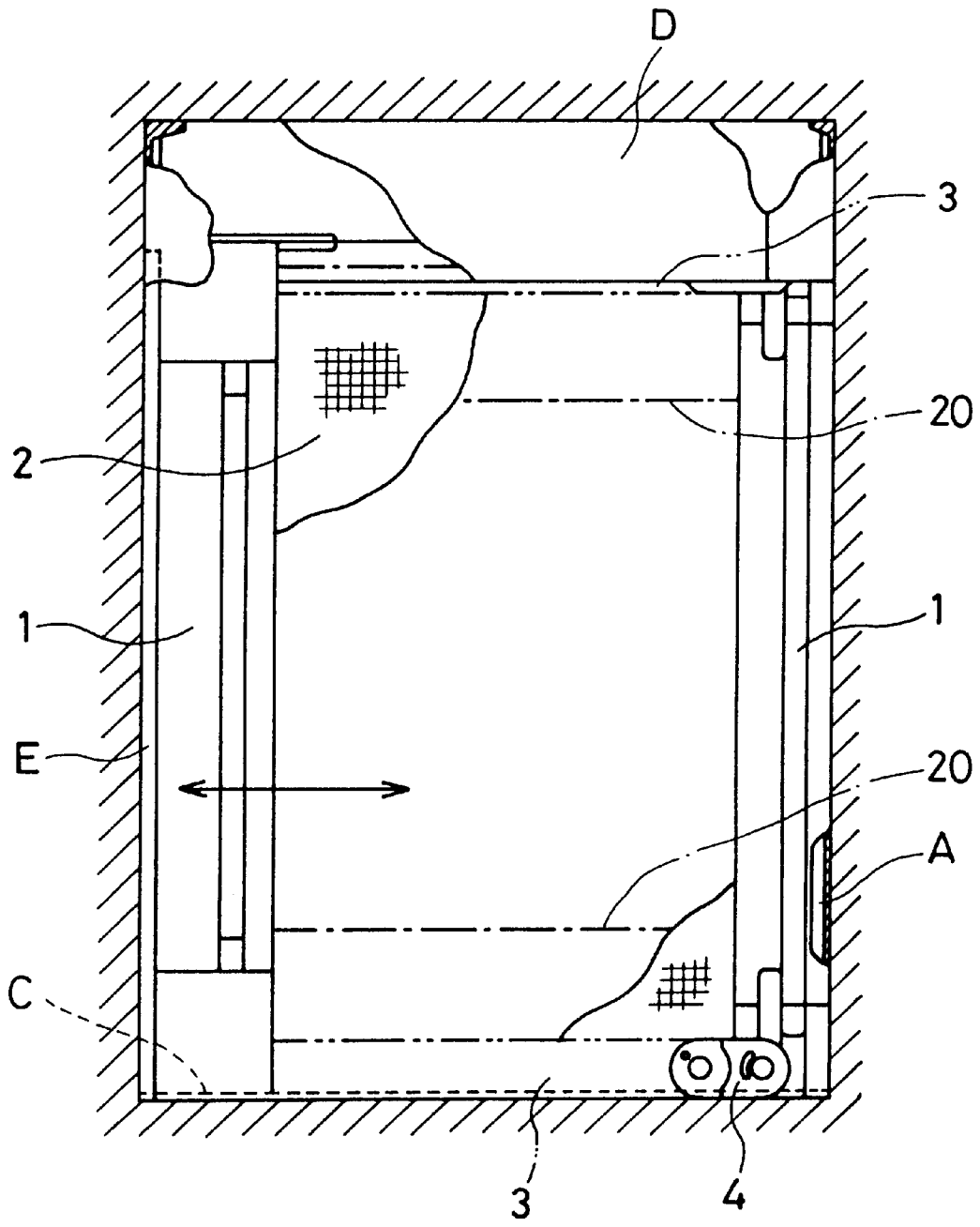
FIG. 1 is a side elevation of an embodiment of a screen device.
Figure 2:
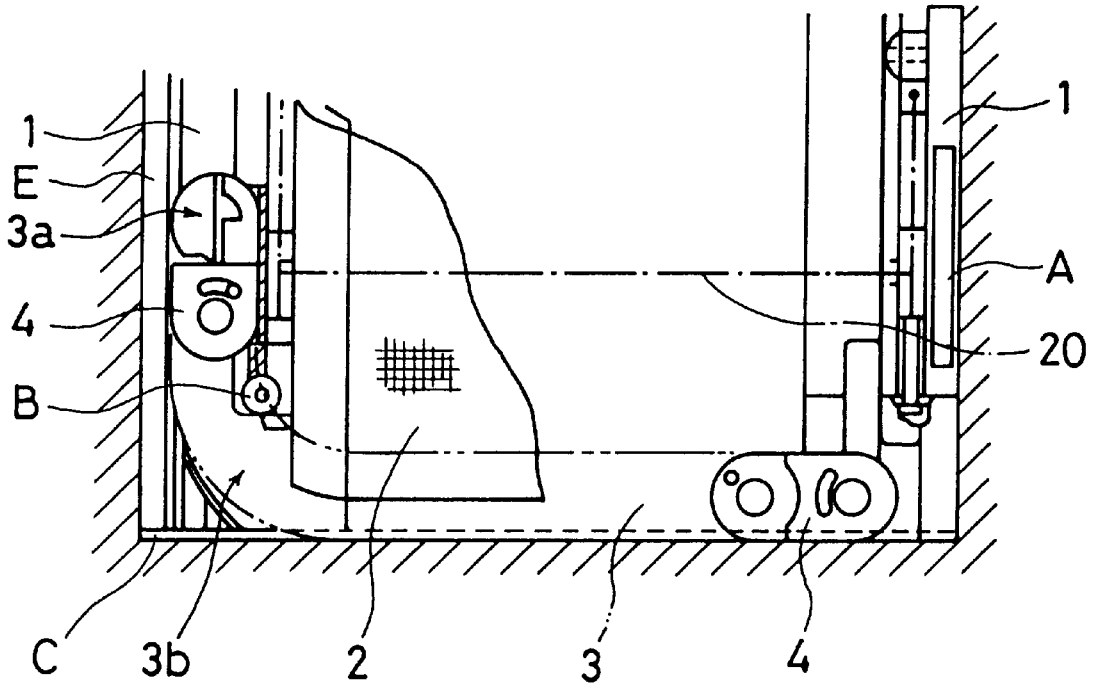
FIG. 2 is a cross-sectional view of main portions of the screen device shown in FIG. 1

A screen device of the present invention has such a structure as shown in FIGS. 1 and 2. The screen device has a pair of screen mounting frames 1 located opposite to each other. At least one of the frames 1 can slide. A screen 2 is mounted to the mounting frames 1 so as to be capable of being folded and unfolded between the frames 1. The screen 2 can be made of a cloth, a plastic sheet, a meshwork, a plurality of slats coupled together, or any combination thereof The screen 2 is opened and closed in accordance with sliding movement of at least one of the frames 1. Preferably, the screen 2 is pleated.

The screen device also has sliding guide frames 3 near at least one end of the screen 2 that is not mounted to the screen mounting frames 1, The sliding guide frames 3 guide sliding movement of the slidable screen mounting frame 1. Rigid units 4 are coupled together to form the sliding guide frames 3.

As shown in FIGS. 3A–3D, each rigid unit 4 has a pair of sidewalls 5 located opposite to each other and a bridging portion 6 interconnecting the sidewalls 5. For example, a protrusion 7 projecting outward can be formed on one end of each sidewall 5, while a hole 8 in which the protrusion 7 can be engaged can be formed on the other end of the each sidewall 5.

Figure 4:
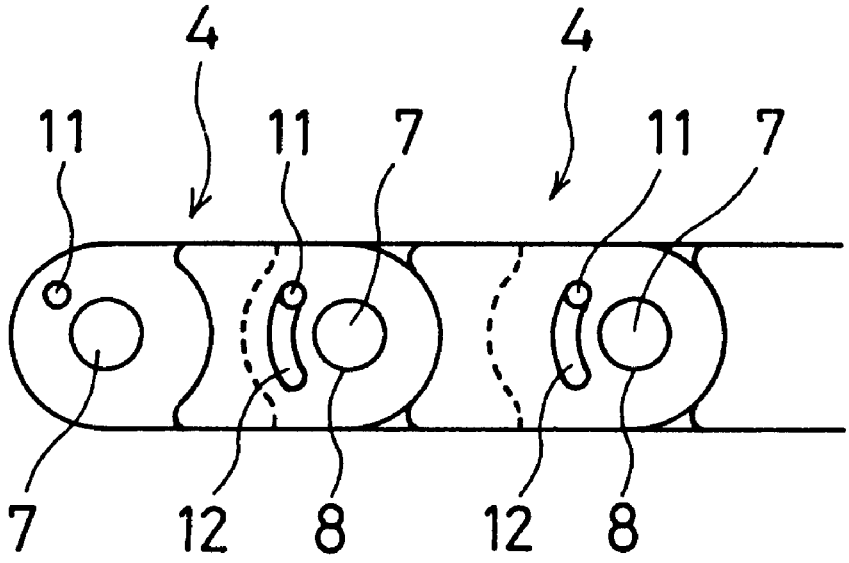
FIG. 4 is a side elevational view of main portions of a sliding guide frame formed by the rigid unit shown in FIGS. 3A–3D.

As shown in FIG. 4, two adjacent rigid units 4 can be joined together by fitting the protrusions 7 into the holes 8 from the rear sides of the sidewalls 5. For instance, the sliding guide frame 3 formed by the rigid units 4 can be rotated between the two adjacent rigid units 4. Consequently, the sliding guide frame 3 is bendable. A shown in FIG. 2, at least one end of the sliding guide frame 3 is a free end 3*a* which, with the bendable nature of the sliding guide frame 3, permits the sliding guide frame 3 to be brought into and out of the screen mounting frames 1. The other end of the sliding guide frame 3 can similarly be a free end 3*a*, while, as mentioned later, it can be otherwise fixedly mounted to one of the screen mounting frames 1.

The screen mounting frames 1 are formed into a hollow shape in order that the sliding guide frames 3 can be brought into and out of the screen mounting frames 1. The hollow space in each screen mounting frame 1 may be one single space or plural subspaces divided. In the latter case, a pair of sliding guide frames 3 located near both ends of the screen 2 not mounted to the screen mounting frames 1 can be received into the subspaces, respectively. Furthermore, if the sliding guide frames 3 are elongated, they can be smoothly received without any interference between the sliding guide frames 3. This permits a distance between the screen mounting frames 1 to be long.

Each sliding guide frame 3 is equipped with a stopper mechanism. When each sliding guide frame 3 is withdrawn from inside of the screen mounting frame 1 in accordance with sliding movement of the slidable screen mounting frame 1, the withdrawn portion of the each sliding guide frame 3 is kept straight by the stopper mechanism, and this realizes preservation of a prescribed distance between the screen mounting frames 1.

Figure 3D:
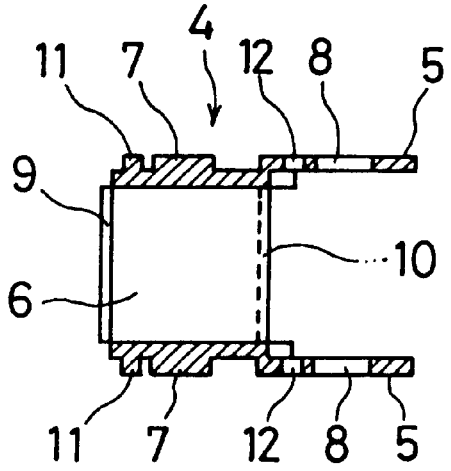
FIG. 3D is a cross-sectional view taken on line X—X of FIG. 3A.
Figure 3A:
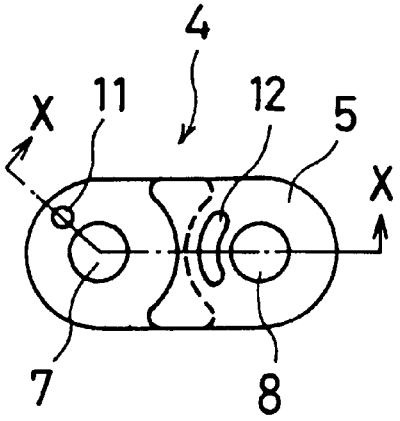
FIG. 3A is a front elevational view of a rigid unit forming a sliding guide frame of the screen device shown in FIGS. 1 and 2.

The stopper mechanism can be mounted to the linking portions between the two adjacent rigid units 4. A stepped structure can be provided for the stopper mechanism. The stepped structure can be mounted at either end of the bridging portion 6 of the rigid units 4. As shown in FIGS. 3C and 3D, the stepped structure consists of a first step 9 and a second step 10. The first step 9 is formed by cutting a part of the surface at one end of the bridging portion 6. The second step 10 is formed by cutting a part of the rear face at the other end of the bridging portion 6. When the second step 10 overlaps the first step 9 between two adjacent rigid units 4 coupled together, the stepped structure suppresses rotation of the rigid units 4 and thereby straightness of the sliding guide frames 3 is preserved.

In the screen device of the present invention, an angular pin structure can be also provided for the stopper mechanism. The angular pin structure can be mounted on the sidewalls 5 of each rigid unit 4. The angular pin structure consists of small protrusions 11 extending outward from the sidewalls 5 of each rigid unit 4, and crescent slots 12 capable of accepting the small protrusions 11. When the small protrusions 11 are inserted into the slots 12 between two adjacent rigid units 4 coupled together, and each small protrusion 11 comes into contact with one end of a corresponding slot 12, the angular pin structure Suppresses rotation of the rigid units 4 and thereby straightness of the sliding guide frames 3 is preserved.

In the present invention, either or both of the stepped structure and angular pin structure can be adopted for the stopper mechanism. However, the stopper mechanism is not limited to the stepped structure and angular pin structure. Any other structure may be adopted for the stopper mechanism as long as straightness of the withdrawn portions of the sliding guide frames 3 from inside of the screen mounting flames 1 is maintained.

In the screen device of the present invention, since the sliding guide frames 3 which guide sliding movement of the slidable screen mounting frame 1 are withdrawn from and received into the screen mounting frame 1, the sliding guide frames 3 are not fixed frames. Consequently, limitations which would normally be placed on installation when a screen device is used as light-shielding means or light-controlling means such as a curtain or a blind, an insect screen, a fixed partition, or a movable partition are eliminated. Since each sliding guide frame 3 is composed of the rigid units 4, each sliding guide frame 3 has a good combination of rigidity and bending ability and thereby excellent operability and shape stability of the screen are accomplished.

In the case that a screen device is employed as a curtain, a blind, as shown in FIGS. 1 and 2, an insect screen, a partition, or the like, the screen device can be installed in a window opening, on a wall, in a wall opening, on an article of furniture, on a post, on a ceiling, on a floor, or on both a ceiling and a floor by securing one screen mounting frame 1 with an anchoring member A or the like.

Figure 5:
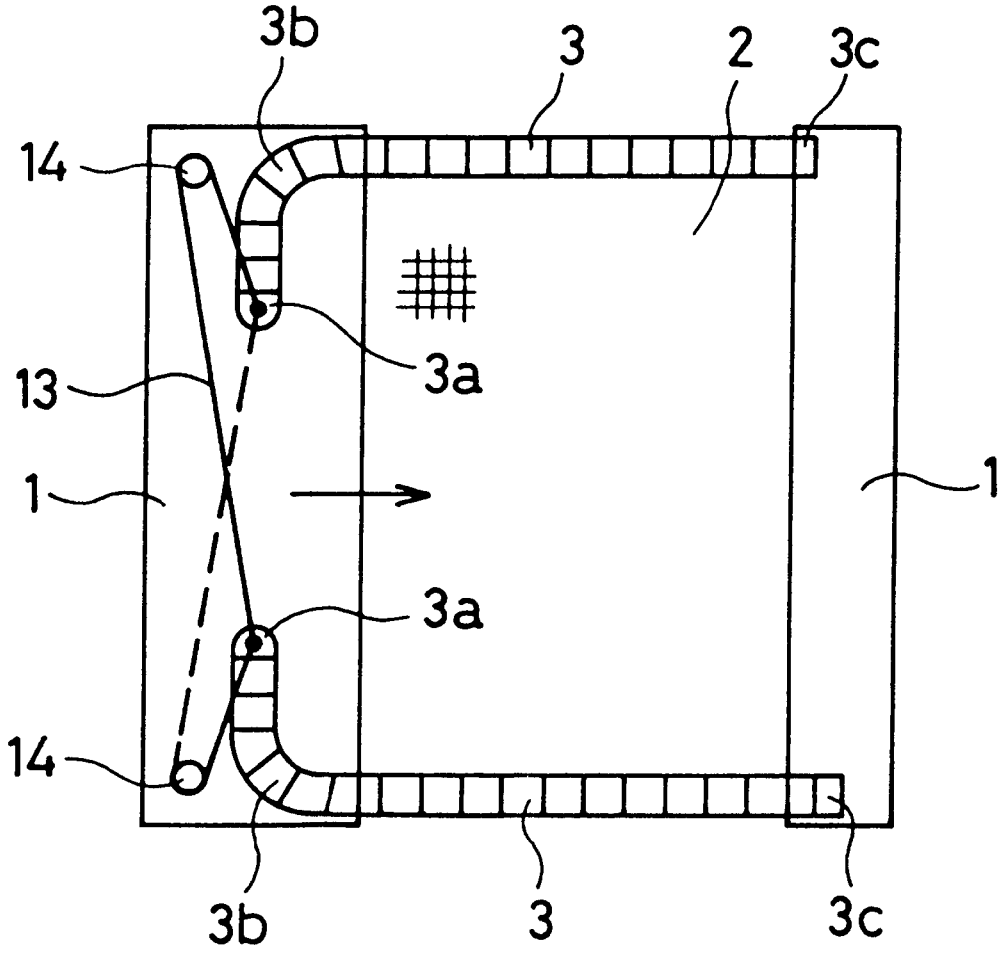
FIG. 5 is a schematic view of another embodiment of a screen device.

In the case that a pair of sliding guide frames 3 are mounted near both ends of the screen 2 that are not mounted to the screen mounting frames 1, as shown in FIG. 5, the free ends 3*a* of the sliding guide frames 3 can be coupled together with a tensioning member 13 which forms a cross-loop and is mounted in the screen mounting frames 1. In addition, bent points 14 of the tensioning member 13 can be disposed on the opposite side of the sliding guide frames 3 to the side mounted to the screen 2. A cord, a wire, or any other appropriate member can be adopted for the tensioning member 13. Smooth parallel translation of the slidable screen mounting frame 1 is assured by the tensioning member 13 forming the cross-loop and its bent points 14 disposed at the aforementioned position. This is because each sliding guide frame 3 moves substantially equal amounts. For example, when one screen mounting frame 1 is operated at a portion close to its bottom end to slide in the direction indicated by the arrow in FIG. 5, in this case rattle would occur in the screen device, the upper sliding guide frame 3 receives a tensile force while the lower sliding guide frame 3 undergoes a compressive force. When the slidable screen mounting frame 1 is operated to slide in the opposite direction, the lower sliding guide frame 3 receives a tensile force. Even if the slidable screen mounting frame 1 is operated under conditions which would normally tend to induce rattle, the sliding guide frames 3 are smoothly received into and withdrawn from inside of the screen mounting frames 1, and smooth parallel translation of the slidable screen mounting frames 1 is realized. Consequently, even if, at each bent portion 3*b*, frictional resistance exists between the sliding guide frames 3 and the screen mounting frame 1, or even if unavoidable bending or elongation exists in the tensioning member 13, the effects caused by these are suppressed. Furthermore, straightness of the withdrawn portions from inside of the sliding guide frames 1 can be easily maintained.

Figure 6:
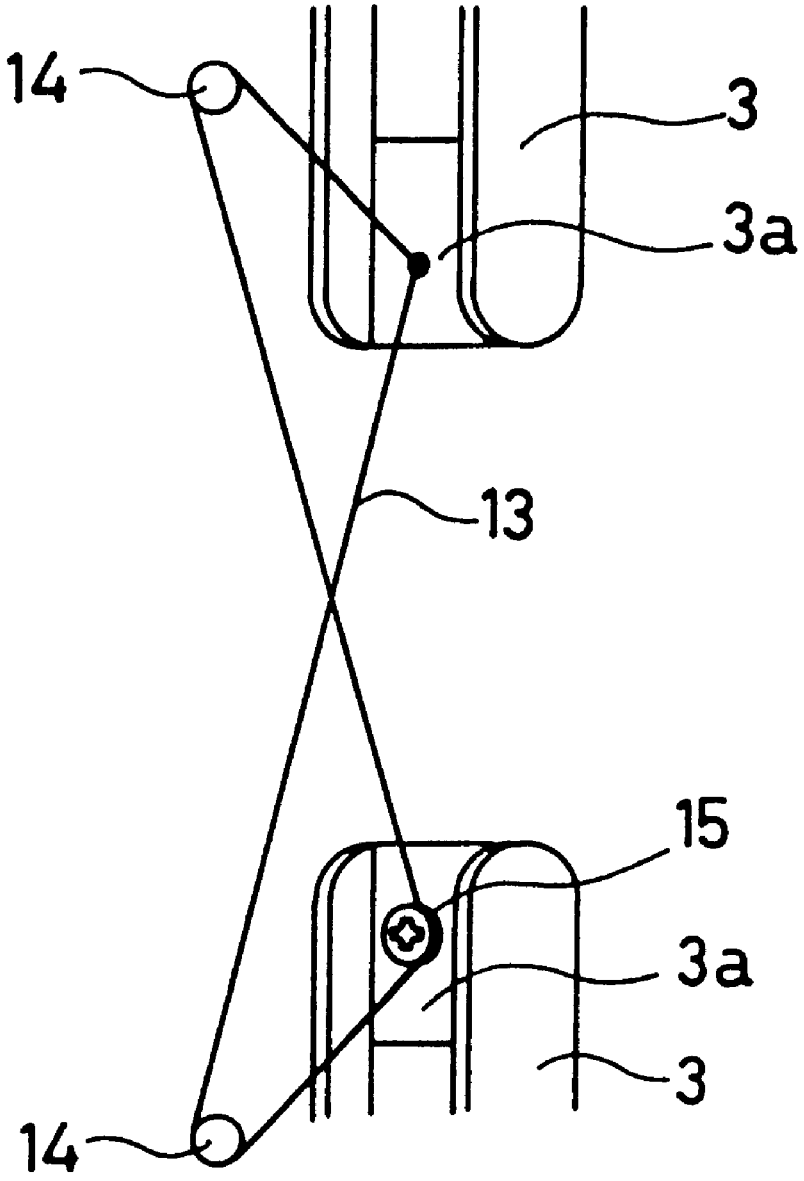
FIG. 6 is a perspective view of main portions of tensioning members, showing a manner in which the tensioning members are fixedly mounted to a sliding guide frame.

As shown in FIG. 6, the tensioning tensioning 13 can be rigidly secured to the free end 3*a* of one sliding guide frame 3. With respect to the other sliding guide frame 3, the securing position to the free end 3*a* can be variable. Adjustment of the sectoring position can be realized with a screw 15, for example. That is, the tensioning member 13 can be secured at arbitrary positions to the free end 3*a* of the sliding guide frame 3 with a screw 15. This facilitates adjustment of the relative position of the screen mounting frames 1 when a screen device is installed. Therefore, a screen device can be installed easily.

Of course, since the tensioning member 13 is secured to the free ends 3*a* of the sliding guide frames 3 when a screen device is assembled, at this time, the length of the tensioning member 13 can be adjusted.

Figure 7:
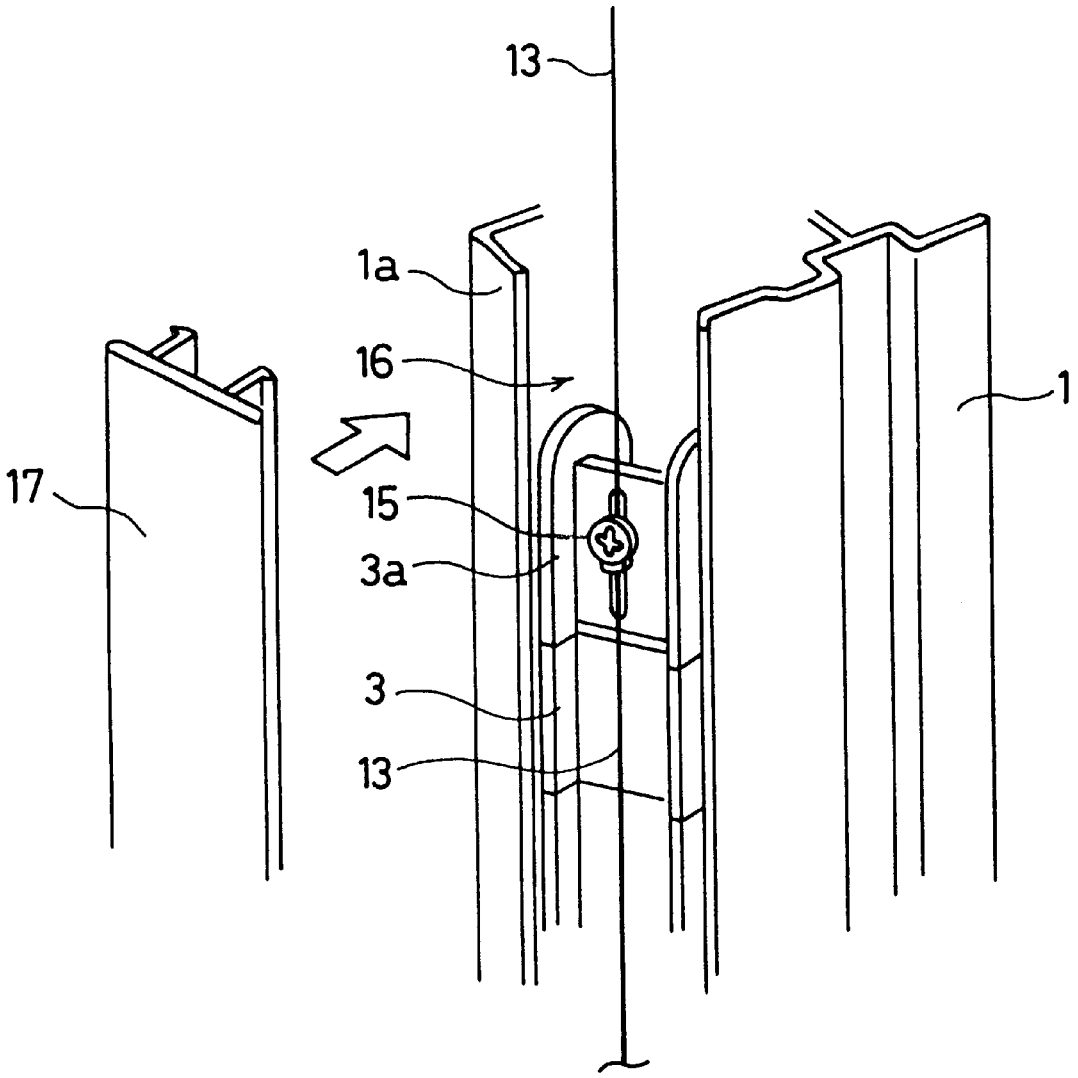
FIG. 7 is an exploded perspective view of main portions of a screen mounting frame.

As shown in FIG. 7, in order to facilitate the adjustment of the securing position and the length of the tensioning member 13, an opening 16 can be formed at an end surface 1*a* of the screen mounting frame 1 which is opposite to the side to which the screen 2 is mounted. In addition, a cover 17 can be detachably mounted to the opening 16 without forming any gap between the opening and the cover, Adjustment of the securing position and the length of the tensioning members 13 when a screen device is installed can be operated through the opening 16.

Figure 3B:
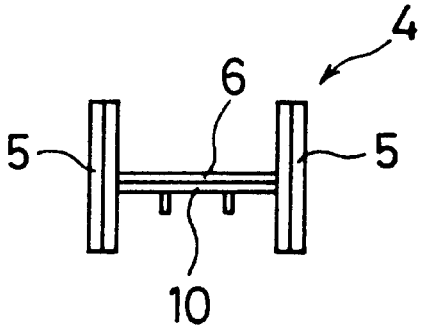
FIG. 3B is a side elevational view of the rigid unit shown in FIG. 3A.
Figure 3C:
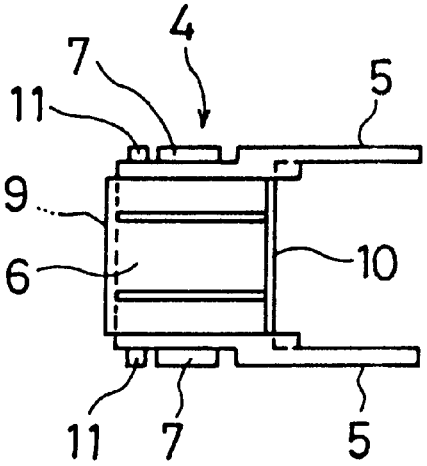
FIG. 3C is a bottom view of the rigid unit shown in FIG. 3A.

As shown in FIG. 3B, the bridging portion 6 of the rigid unit 4 can be placed at the middle position of the sidewalls 5. This placement is effective not only in maintaining rigidity of the rigid unit 4 but also in making sliding movement of the sliding guide frames 3 smooth.

Figure 8A:
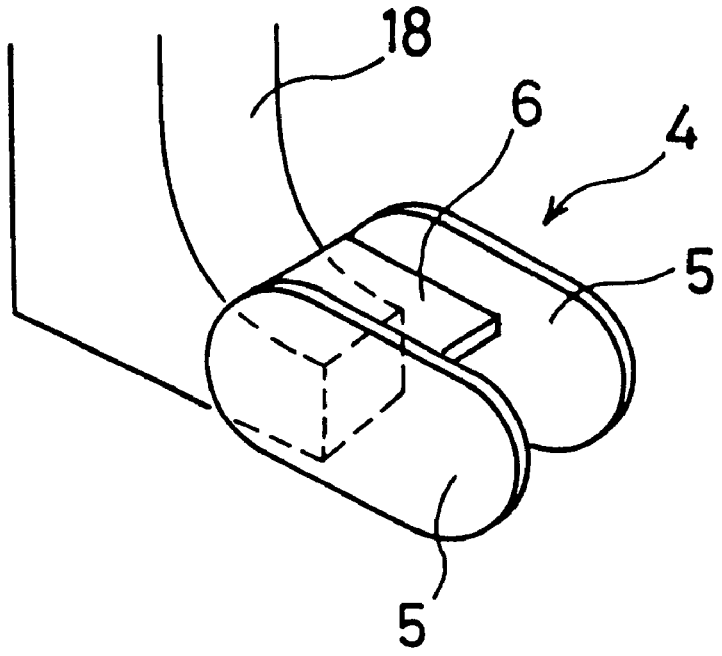
FIG. 8A is a schematic perspective view of main portions of a rigid unit forming a sliding guide frame and a screen mounting frame.
Figure 8B:
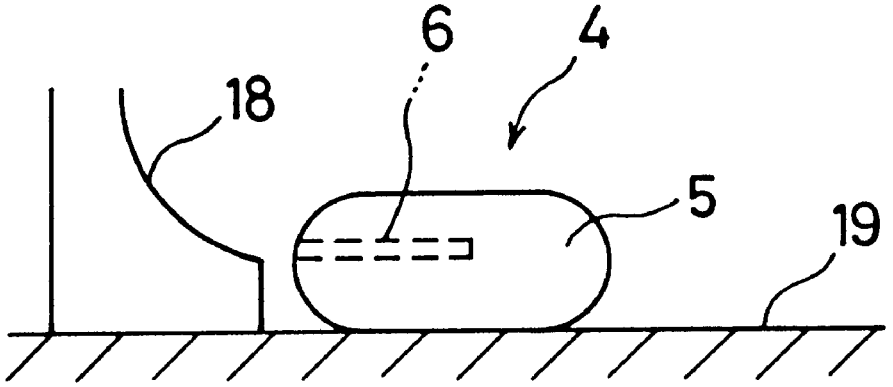
FIG. 8B is a schematic side elevational view of the main portions shown in FIG. 8A.

That is, as shown in FIGS. 8A and 8B, in the case that a bearing surface 18 which can come into contact with a rear surface of the bridging portion 6 of the rigid unit 4 is provided in the screen mounting frames 1, the bearing surface 18 guides the bridging portion 6 from its rear surface, and when the sliding guide frames 3 are received in the screen mounting frames 1, the sliding guide frames 3 are smoothly bent at the bend portions 3*b*. Thus, sliding movement of the sliding guide frames 3 can be smoothed. In addition, the bridging portion 6 comes into contact neither with a floor surface 19 on which a screen device is mounted nor with a lower frame portion or the like mounted in an opening. Therefore, sand, mud, dust, or the like existing on the floor surface 19 and the lower frame or the like does not attach to the rear surface of the bridging portion 6. Frictional resistance between the bearing surface 18 and the bridging portion 6 do not increase, and wear caused by the frictional resistance is suppressed.

As shown in FIG. 2, rollers B which can come into contact with the surface of the bridging portion 6 of the rigid unit 4 can be provided in the screen mounting frames 1. The rollers B allow the sliding guide frames 3 to be smoothly bent at the bent portions 3*b*, and thereby sliding movement of the sliding guide frames 3 is smoother.

Figure 9:
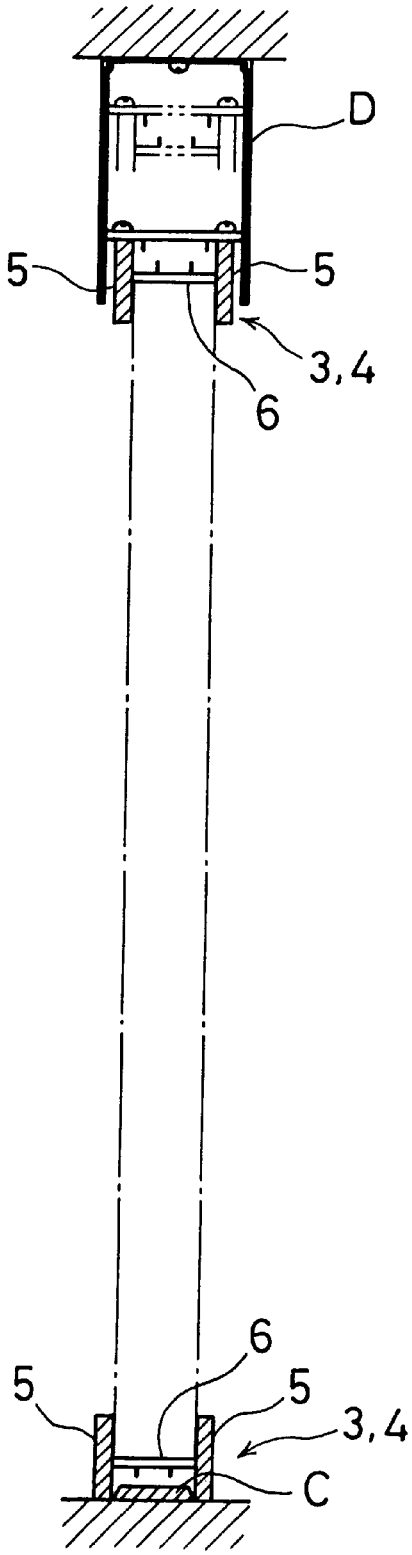
FIG. 9 is a vertical cross sectional view of the screen device shown in FIG. 1.

As shown in FIGS. 1, 2, and 9, a lower rail C having a width inserted between the sidewalls 5 of the rigid unit 4 can be mounted either on the floor surface 19 on which a screen device is installed or on the lower frame mounted in tie opening. This lower rail C guides sliding movement of the sliding guide frames 3.

In the case that a screen device is used as a curtain, a blind, an insect screen, a partition, or the like, as shown in FIGS. 1 and 9, an upper rail D wider than the sliding guide frames 3 can be mounted on the ceiling surface or on the upper frame in the opening in order to guide sliding movement of the sliding guide frame 3. This upper rail D is also effective in hiding a gap formed between the top end of a screen device and the ceiling surface or the upper frame in the opening.

It is noted that the lower rail C and the upper rail D are not fixed frames referred to in the present invention. They are only supplementary guiding means for the sliding guide frames 3 which can be provided when needed. Accordingly, the lower rail C and the upper rail D by no means restrict installation of a screen device of the present invention.

As mentioned previously, the other end, which is not the free end 3*a*, of the sliding guide frame 3 may be either a fixed end or a free end. In the screen device shown in FIG. 5, the other end of the sliding guide frame 3 is a fixed end 3*c* that is fixed to the screen mounting frame 1 therein. On the other hand, in the screen device shown in FIG. 10, both ends of the sliding guide frames 3 are free ends 3*a*. Consequently, the sliding guide frames 3 can be received in and withdrawn from both of the screen mounting frames 1 in accordance with sliding movement of the screen mounting frames 1. In a similar case shown in FIG. 5, a pair of sliding guide frames 3 can be coupled together at their free ends 3*a* by tensioning member 13 forming a cross-loop, which is mounted in the screen frame mounting frames 1, and bent points 14 of the tensioning member 13 can be positioned at the side of the sliding guide frame 3 opposite to the side to which the screen 2 is mounted.

Figure 10:
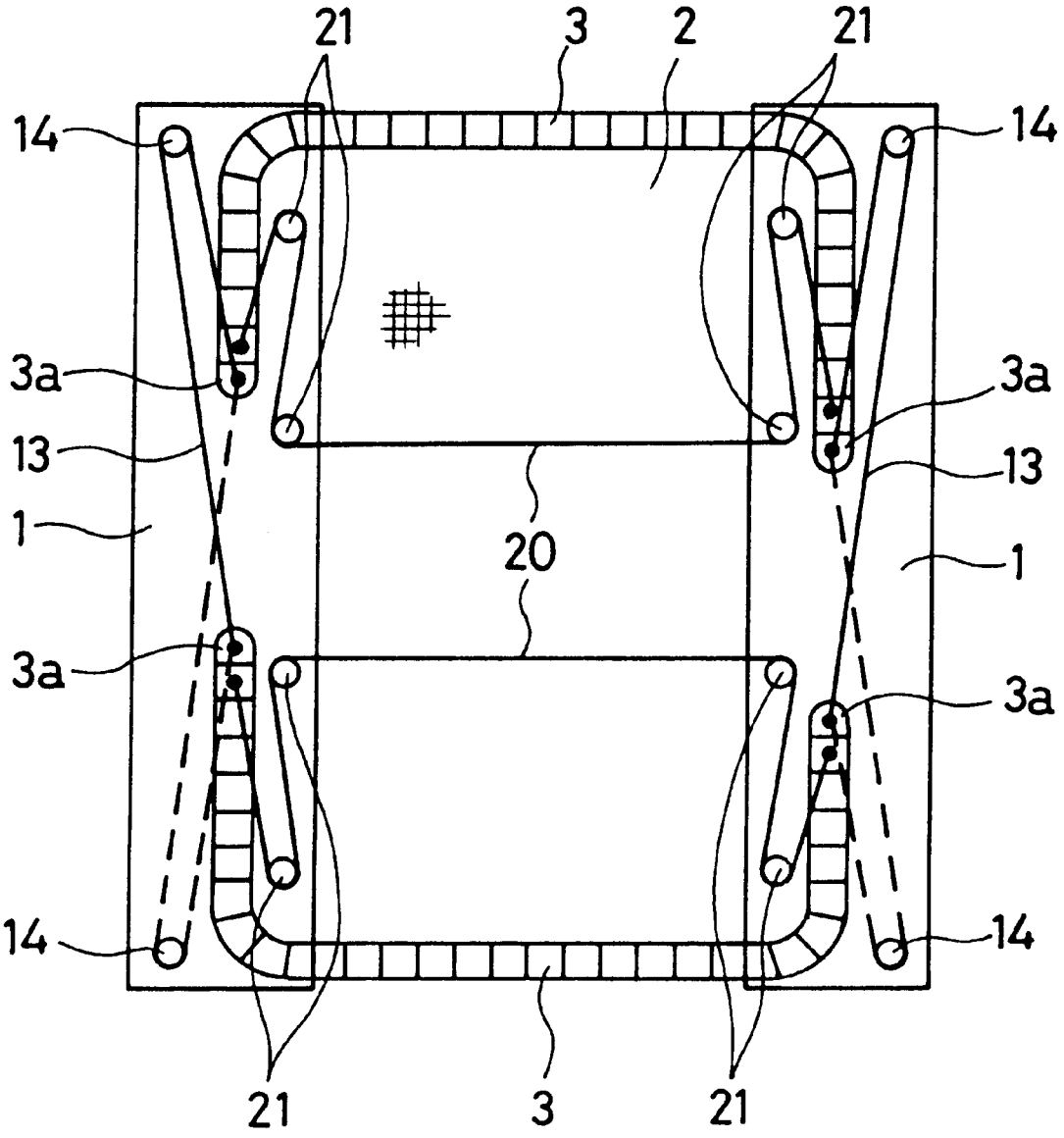
FIG. 10 is a conceptual view of a further embodiment of a screen device.

Furthermore, in a screen device of the present invention, the screen 2 is preferably pleated. In this case, tension supporting members 20 such as a cord, wire, or the like, are stretched between a pair of screen mounting frames 1 by piercing the screen 2 in order to support upright standing of the screen 2 and increase surface rigidity. No limitations ire imposed on the number and the manner of piercing of the tension support members 20 as long as a desired object is achieved. For example, as shown in FIGS. 1 and 10, two tension supporting members 20 can be used and bent in the screen mounting frames 1 to produce desired tension. As shown in FIG. 10, both ends of each tension supporting member 20 can be secured near the free ends 3*a* of the sliding guide frames 3 and cranked at two bent points 21 disposed in the screen mounting frames 1. The length of each tension supporting member 20 will be also adjustable if the opening 16 is formed as shown in FIG. 7.

Figure 11:
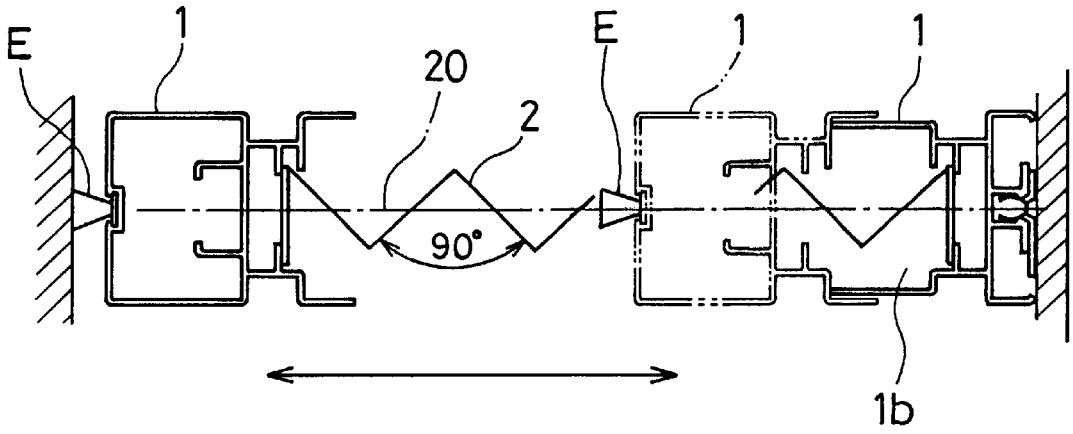
FIG. 11 is a horizontal cross sectional view of the screen device shown in FIG. 1.

In the case that the screen 2 is pleated, as shown in FIG. 11, the angle of the pleats when the screen is fully unfolded can be set to about 90°. The screen mounting frame 1 can be also provided with a receptacle portion 1*b* in which the screen 2 can be received after folded.

Of course, a screen without pleats can be adopted for the screen 2. In this case, in order to facilitate opening and closing of the screen 2, a winding device using a roller can be mounted in the screen mounting frames 1. The screen 2 is can be wound on the winding device and stored compactly. When the screen 2 is opened, it can be unwound from the winding device. In the roller-type winding device, a spring mechanism producing a resilient force in the direction to wind the screen 2 by rotating the roller can also provided, facilitating winding the screen 2.

In the case that a screen device is used as a curtain, a blind, an insect screen, a partition, or the like, as shown in FIGS. 1, 2, and 11, mohair E or the like formed by an assembly of long fibers can be attached to the end surface of-the slidable screen mounting frames 1. This mohair E or the like is effective in hiding a small gap even if it is formed between the slidable screens mounting frames 1 and a window opening, a wall, a wall opening, an article of furniture, a post, or the like.

Figure 12:
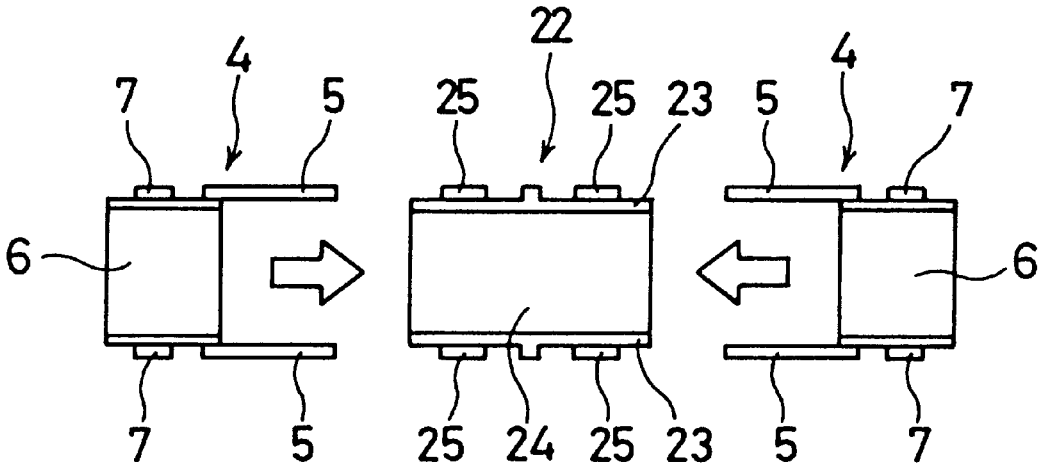
FIG. 12 is an exploded plan view of main portions of a sliding guide frame in the screen device shown in FIG. 10.
Figure 13:
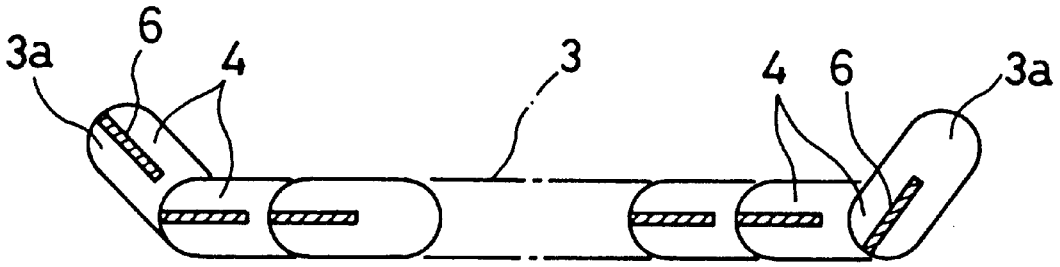
FIG. 13 is a cross-sectional view of main portions of the screen device shown in FIG. 10, showing locus of a bridging portion of a rigid unit when a sliding guide frame slides.

In the case that both ends of each sliding guide frame 3 are free ends 3*a*, as shown in FIG. 10, the sliding guide frame 3 can adopt such a structure as shown in FIG. 12. As mentioned previously, in this case, the sliding guide frames 3 can be received into and withdrawn from the screen mounting frames 1. On the other hand, as show in FIG. 13, locus drawn by the bridging portions 6 of the sliding guide frame 3 which is formed by the rigid units 4 shown in FIGS. 3A–3D differs according to the direction of sliding movement of the sliding guide frame 3. This is because the bridging portion 6 extends from one edge to an almost middle position of the sidewalls 5 in the rigid unit 4 shown in FIGS. 3A–3D, and because the rigid unit 4 does not have symmetry in the vertical direction to the bridging portion 6.

Accordingly, in a screen device of the present invention, as shown in FIG. 12, in order that the bridging portions 6 draw the same locus in spite of the sliding directions of the sliding guide frame 3, the sliding guide frame 3 can be divided into two parts at its center and the parts are reversed relative to each other. In addition, two rigid units 4 which are positioned at an end of each part and disposed opposite to each other are connected by a coupler 22. As shown in FIG. 12, for example, the coupler 22 consists of a pair of sidewalls 23 located opposite to each other and a bridging portion 24 interconnecting the sidewalls 23. Each sidewall 23 has two protrusions 25 which project outward from the sidewall 23 and are spaced from each other longitudinally.

The two rigid units 4 above-mentioned are connected by forcing the sidewalls 23 to be inserted between the sidewalls 5 of the two rigid units 4 and fitting the protrusions 25 into the hole 8 shown in FIGS. 3A and 3D. The sliding guide frame 3 formed in this way is symmetrical about the coupler 22 and therefore, if both ends are free ends 3*a*, locus drawn by the bridging portions 6 of the rigid units 4 is same irrespective of sliding directions of the sliding guide frame 3. This permits a common bearing surface 18 to be used in a pair of the screen mounting frames 1. Furthermore, a common rigid unit 4 can be used for the sliding guide frame 3. This contributes to decrease cost of a screen device.

The invention is not limited to the above-mentioned embodiments. It is needless to mention that various modifications are possible with respect to the detailed strictures of screen mounting frames, sliding guide frames, and a screen.

What is claimed is:

1. A screen device, comprising:

first and second opposing frame portions translatable relative to one another;

a screen, having opposing first and second edges, positioned between said first and second frame portions; and a first guide frame portion attached to one of said first and second edges of said screen, wherein said first guide frame portion includes a plurality of rigid units each having first and second sidewalls, with adjacent ones of said plurality of rigid units being rotatably connected together about an axis passing through the first and second sidewalls of one of said adjacent ones of said plurality of rigid units, such that as said first frame portion is translated relative to said second frame portion said screen and said first guide frame portion correspondingly move, wherein said one of said adjacent ones of said plurality of rigid units rotates about said axis relative to the rigid unit to which said one of said adjacent ones of said plurality of rigid units is rotatably connected, whereby said first guide frame portion moves along a curved path.

2. The screen device according to claim 1, wherein said adjacent ones of said plurality of rigid units include a stopper mechanism to limit the extent that said one of said adjacent ones of said plurality of rigid units rotates relative to said rigid unit to which said one of said adjacent ones of said plurality of rigid units is rotatably connected, such that when the rotation of said one of said adjacent ones of said plurality of rigid units is limited by said stopper mechanism said one of said adjacent ones of said plurality of rigid units is generally axially aligned with said rigid unit to which said one of said adjacent ones of said plurality of rigid units is rotatably connected, whereby said first guide frame portion moves along a generally linear path after moving along the curved path in response to the relative translation of said first and second frame portions.

3. The screen device according to claim 2, wherein said adjacent ones of said plurality of rigid units each include a bridge portion interconnecting said sidewalls.

4. The screen device according to claim 3, wherein said bridge portion includes a first stepped surface at a front side thereof and a second stepped surface at a rear side thereof, and wherein said stopper mechanism comprises said first and second stepped surfaces, whereby said first stepped surface of said bridge portion of said one of said adjacent ones of said plurality of rigid units cooperates with said second stepped surface of said bridge portion of said rigid unit to which said one of said adjacent ones of said plurality of rigid units is rotatably connected to limit the rotation of said one of said adjacent ones of said plurality of rigid units relative to said rigid unit to which said one of said adjacent ones of said plurality of rigid units is rotatably connected.

5. The screen device according to claim 2, wherein at least one of said first and second sidewalls of each of said adjacent ones of said plurality of rigid units includes a protrusion extending laterally therefrom, and at least one of said first and second sidewalls of each of said adjacent ones of said plurality of rigid units includes a slot, and wherein said stopper mechanism comprises said protrusion and said slot, whereby said protrusion of said at least one of said first and second sidewalls of said one of said adjacent ones of said plurality of rigid units is received within said slot of said at least one of said first and second sidewalls of said rigid unit to which said one of said adjacent ones of said plurality of rigid units is rotatably connected, such that the rotation of said one of said adjacent ones of said plurality of rigid units relative to said rigid unit to which said one said adjacent ones of said plurality of rigid units is rotatably connected is limited when said protrusion engages an end wall of said slot.

6. The screen device according to claim 5, wherein one of said protrusions extends from each of said first and second sidewalls of each of said adjacent ones of said plurality of rigid units, and each of said first and second sidewalls of each of said adjacent ones of said plurality of rigid segments includes one of said slots.

7. The screen device according to claim 2, and further comprising:

a second guide frame portion attached to the other of said first and second edges of said screen, wherein said second guide frame portion includes another plurality of rigid units each having first and second sidewalls, with adjacent ones of said another plurality of rigid units being rotatably connected together about an axis passing through the first and second sidewalls of one of said adjacent ones of said another plurality of rigid units, such that as said first frame portion is translated relative to said second frame portion said screen and said second guide frame portion correspondingly move, wherein said one of said adjacent ones of said another plurality of rigid units rotates about said axis relative to the rigid unit to which said one of said adjacent ones of said another plurality of rigid units is rotatably connected, whereby said second guide frame portion moves along a curved path, wherein a first end of each of said first guide frame portion and said second guide frame portion is attached to said first frame portion; and a tensioning member connected to said second frame portion and a second end of each of said first guide frame portion and said second guide frame portion.

8. The screen device according to clam 7, wherein said tensioning member crosses over itself loops around portions of said second frame portion.

9. The screen device according to claim 8, wherein the positions at which said tensioning member is connected to said second end of each of said first guide frame portion and said second guide frame portion are variable.

10. The screen device according to claim 9, wherein said second frame portion includes an opening in which said tensioning member is received, and further comprising a cover that is detachably mountable to said second frame portion to cover said opening.

11. The screen device according to claim 3, wherein a bearing surface is provided in at least one of said first frame portion and said second frame portion, said bearing surface being engageable with a rear surface of said bridge portion.

12. The screen device according to claim 3, wherein said screen comprises at least one of a cloth, meshwork, and coupled slats.

13. The screen device according to claim 12, wherein said screen is pleated.

14. The screen device according to claim 13, and further comprising at least one tension supporting member, to support said screen, connected between said first frame portion and said second frame portion.

* * * * *